US005421761A

United States Patent [19]

Pitcher et al.

[11] Patent Number: 5,421,761

[45] Date of Patent: Jun. 6, 1995

[54] CONCEALABLE TOY DOLL

[75] Inventors: Jennifer L. Pitcher; Marolyn R. Pitcher, both of Columbus; Ray Dyson, Milford, all of Ohio

[73] Assignee: My Best Toys, Inc., Columbus, Ohio

[21] Appl. No.: 257,827

[22] Filed: Jun. 9, 1994

[51] Int. Cl.[6] ..... A63H 3/02

[52] U.S. Cl. ..... 446/74; 446/369

[58] Field of Search ..... 446/74, 369, 268

[56] References Cited

U.S. PATENT DOCUMENTS 1,304,434 5/1919 Wingert ..... 446/369
1,407,165 2/1922 Pajeau ..... 446/74
1,437,467 12/1922 Dykman ..... 446/74
1,583,284 5/1926 Dykman ..... 446/74

*Primary Examiner*—Mickey Yu
*Attorney, Agent, or Firm*—Wood, Herron & Evans

[57] ABSTRACT

An improved concealable toy doll, whose garments may be inverted to conceal the doll and form a convenient carrying sack. Improvements include a construction in which the toy doll wears a single-piece, full-body gown and has an interior sack within the body to prevent the stuffing material from shifting. Further improvements include a hollow compressible chamber between the body and carrying sack, which allows the user to pull the carrying sack up and over the body and head of the toy doll with ease.

5 Claims, 1 Drawing Sheet

CONCEALABLE TOY DOLL

BACKGROUND OF THE INVENTION

This invention relates to toy dolls, and more particularly, to toy dolls whose garments can be inverted to form convenient carrying sacks for the dolls.

Dykman (U.S. Pat. No. 1,437,467) discloses a doll which includes an integral carrying sack. The toy doll includes a garment extending from the waist which forms a skirt when fully extended away from the head. The garment may be inverted and pulled up and over the body and head of the toy doll, concealing the doll from view.

However, the doll disclosed in Dykman has some limitations. The doll appears to have a solid plastic body with either flexible or rigid arms. This material is too hard to be enjoyed by a small child, and therefore, it would be advantageous to have a toy doll made of softer materials. Furthermore, the design of the Dykman toy doll requires the garment to be gathered about the waist of the body. This aspect limits both the outer shape of the toy doll as well as the kinds of garments that may be worn. Therefore, it also would be desirable to have a toy doll with a single outer garment that does not have to be gathered about the waist.

SUMMARY OF THE INVENTION

It is an object of the present invention to provide a toy doll having a head, a body, a carrying sack, and a gown. With such a doll, the body is attached to the head; and the carrying sack is attached to a hollow chamber which is connected to the bottom edge of the body. The body's gown is also attached to the carrying sack opposite the body. The gown is placed over the body, appearing in full view and concealing the carrying sack. However, the gown may be inverted and pulled up toward the head, exposing the carrying sack. If desired, the sack may be folded up to cover the body and the head.

In its preferred form, the toy doll further includes a drawstring located at or near the bottom edge of the gown or the opposed edge of the carrying sack. When the carrying sack is pulled up around the body or head of the toy doll, the drawstring may be drawn tight, providing convenient carrying handles for the toy.

One of the advantages of the construction of the body, carrying sack and gown according to this invention is that the finished toy is a single piece with no detachable parts. Therefore, the gown and carrying sack will not become separated from the toy doll and lost. Another advantage of the invention is the design of the gown, including the way in which the gown fits over the entire body and the inverted carrying sack of the toy doll. Therefore, when the gown is in the fully extended position away from the head, the garment has a flowing single-piece appearance, and does not have to be cinched about the waist of the body.

A further object of the invention is to provide a toy doll having a body with an outer fabric surface and an inner sack located inside the outer fabric surface. Both the inner sack and the outer fabric surface are filled with compressible stuffing material which helps define the plush shape and feel of the toy doll. The inner sack is attached to the upper section of the body and forms a stationary chamber for stuffing material. One of the advantages of having the inner sack within the outer fabric surface of the body is to keep the compressible stuffing material well distributed throughout the body, and to prevent the material from settling.

Another advantage is the use of a hollow chamber, linking the body to the carry sack. Because the hollow chamber contains no stuffing material, the user is able to pull the carrying sack up and over the body and head of the doll without difficulty.

These and other objectives and advantages will become apparent to one skilled in the art from the following detailed description of a preferred embodiment and from the drawings.

DETAILED DESCRIPTION OF THE INVENTION

Figure 1:
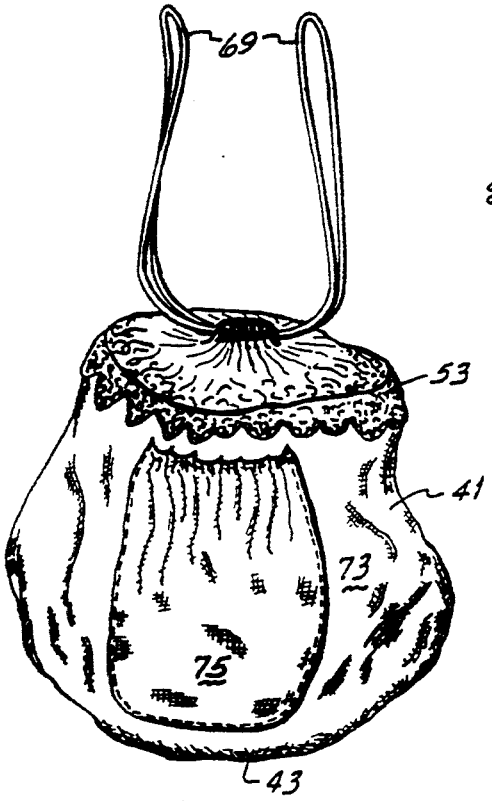
FIG. 1 is an elevational view of a toy doll wrapped in a carrying sack.
Figure 2:
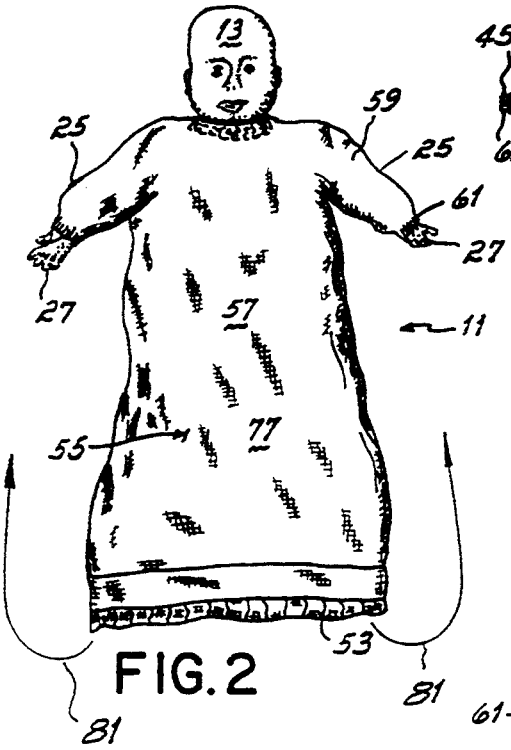
FIG. 2 is an elevational view of the toy doll of FIG. 1, with the carrying sack pulled down, revealing a gown.
Figure 3:
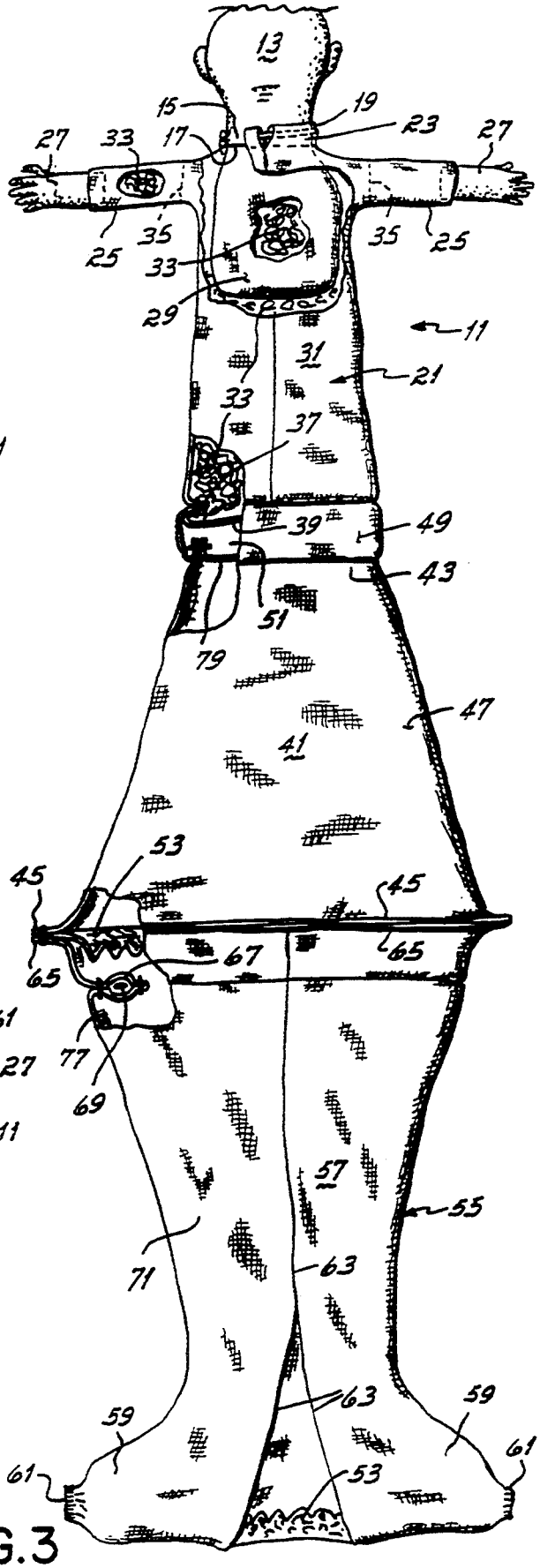
FIG. 3 is an elevational view of the back of a toy doll according to the invention, showing interior detail as well as the connections between the components of the toy doll.

A toy doll 11, according to the preferred embodiment of the invention, is shown in FIGS. 1, 2 and 3. The toy doll 11 includes a head 13, a body 21, a carrying sack 41 and a gown 55 (FIG. 3).

The head 13 includes a neck 15 and a lower flange 17, and preferably is made of flexible molded plastic. The head 13 is connected to the body 21 by a fastener 19 located in a hem 23 attached to the body 21. The fastener 19 fits inside the hem 23 and forms a loop around the neck 15. The fastener 19 shown is a plastic fastener that locks when pulled tight. When pulled snug, the fastener 19 is opposed against the lower flange 17 of the neck 15, securing the head 13 to the body 21 (FIG. 3).

In addition to the hem 23, the body 21 has a torso including an inner sack 29 and an outer sack 31. Both the inner sack 29 and outer sack 31 are filled with a compressible stuffing material 33, preferably a polyester fiber. The inner sack 29 is sewn to the body 21 at the hem 23 and occupies approximately one third to one half of the torso of the body 21. The body 21 further includes arms 25 and hands 27. The arms 25 are filled with compressible stuffing material 33 and are sewn shut at the shoulder seams 35, in order to maintain the stuffing material 33 in the arms. Preferably, the hands 27 are made from a flexible molded plastic material, similar to that used for the head 13. The hands 27 are attached to the arms 25 by stitching the arm fabric to each hand 27 (FIG. 3).

The body 21 is linked to the carrying sack 41 by a circumferential compressible side wall 49. This compressible side wall 49 is made from a cloth similar to that used for the body 21 and arms 25. The compressible side wall 49 is sewn to the bottom edge 37 and bottom face 39 of the body 21, as well as the bottom portion 43 and bottom face 79 of the carrying sack 41. The surfaces define a hollow chamber 51 between the body 21 and the carrying sack 41.

However, before the circumferential compressible side wall 49 is attached to the carrying sac 41, the material used for the carrying sack 41 is inverted, so that the outside surface 73 having a pocket 75 (FIG. 1) is concealed and the inside surface 47 is showing (FIG. 3).

The gown 55 includes an edge 65, a body portion 57, a back seam 63 and two arm portions 59. The arm portions 59 have cuffs 61, which preferably include elastic material to keep the cuffs 61 gathered about the hands 27. The gown 55 also has a hem 67 containing a drawstring 69 (FIG. 3). In the best mode of this invention, the hem 67 and drawstring 69 are located within the gown 55. However, the hem 67 and drawstring 69 also may be placed at the opposed edge 45 of the carrying sack 41 or other similar location. In addition, in a preferred embodiment, the gown 55 includes lace 53 (FIG. 3). Once the gown is formed, it is attached to the carrying sack 41 with it's inside face 71 facing out (FIG. 3), and it's outside face 77 (FIG. 2) facing inward. The edge 65 of the gown 55 is attached to the bottom edge 45 of the carrying sack 41.

With the component parts of the toy doll 11 attached as shown in FIG. 3, the gown 55 is pulled up and over the carrying sack 41 and body 21, displaying the outside face 77 of the gown 55 as shown in FIG. 2. Once this step is performed, the back seam 63 (FIG. 3) of the gown 55 is sewn shut, and the doll 11 appears in full view as shown in FIG. 2.

At this point, the toy doll 11 made according to the invention is ready for use. The toy doll 11 can assume several different shapes and appearances depending upon the orientation of the gown 55 and the carrying sack 41. In its fully extended form, the toy doll 11 appears as in FIG. 2, with the gown 55 being fully extended. However, the toy doll 11 also may be nestled in the carrying sack 41 (FIG. 1) by inverting the gown 55 (see directional arrows 81 in FIG. 2). The carrying sack 41 may be pulled up around the toy doll 11 as much or as little as desired. As shown in FIG. 1, the toy doll 11 is securely nestled in the carrying sack 41 and completely protected from view. However, if the user wants to display a portion of the toy doll 11, the carrying sack 41 does not need to be pulled up all the way. When the drawstrings 69 are pulled snug as in FIG. 1, they may be used as convenient carrying handles to hold the toy doll 11 of this invention. In either instance, the sack 41 is provided with an exposed pocket 75.

The toy doll made according to this invention has several benefits and advantages. One of the advantages is the way in which the compressible stuffing material 33 stays evenly distributed throughout the body of the toy doll because of the compartmentalized design. The inner sack 29 keeps stuffing material in the upper portion of the body, and the stitched seams 35 where the arms meet the body keep stuffing material evenly distributed in the arms. Another advantage is that the finished toy is a single piece with no detachable parts. Therefore, the gown and carrying sack will not become separated from the toy doll and lost. Yet another benefit of the invention is the design of the gown 55, including the way in which the gown fits over the entire body 21 and the inverted carrying sack 41 of the toy doll. Therefore, when the gown is in the fully extended position, away from the head, the garment has a flowing single-piece appearance and does not have to be cinched around the waist of the body.

A further benefit of the invention is the ease with which the body 21 and head 13 may be stuffed into the carrying sack 41. Because the body is connected to the carrying sack by a hollow chamber 51, there is a "free zone" of compression in which the user can pull the carrying sack up and over the body without having to compress stuffing material. This design makes it easier for the user to push the rest of the body and head into the carrying sack if desired.

This invention is not limited to the description discussed above, but on the contrary, is intended to cover the various modifications and equivalent arrangements included within the spirit and scope of the appended claims.

What is claimed is:

1. A toy doll having a head, with a neck portion and a body, said body attached to said neck portion and having a bottom edge and a bottom face opposite said head;

a carrying sack having a bottom portion and opposed edge, the bottom portion of said sack attached to said bottom edge of said body;

a gown having a first edge connected to said opposed edge of said sack whereby said gown is adapted to cover said body and said sack and is adapted to fold up and cover said body and said head and whereby said gown may be removed from said body while remaining connected to said opposed edge of said sack.

2. The toy doll claimed in claim 1 wherein said gown includes a hem adjacent said first edge of said gown, said hem containing a drawstring.

3. The toy doll claimed in claim 1 wherein said opposed edge of said sack includes a drawstring.

4. The toy doll claimed in claim 1 wherein said body has an inner sack attached to said neck portion and an outer sack surrounding said inner sack and attached to said neck portion, wherein said inner sack and outer sack are both filled with a compressible stuffing material.

5. A toy doll having a head, with a neck portion and a body, said body attached to said neck portion and having a bottom edge opposite said head;

a carrying sack having a bottom portion and opposed edge, the bottom portion of said sack attached to said bottom edge of said body:

a gown having a first edge connected to said opposed edge of said sack whereby said gown is adapted to cover said body and said sack and is adapted to fold up and cover said body and said head:

said toy doll further including a hollow compressible chamber located between said body and said carrying sack, said chamber being defined by a circumferential compressible side wall, said bottom edge of said body and said bottom portion of said carrying sack.

* * * * *